US007053035B2

(12) United States Patent
Hanada et al.

(10) Patent No.: US 7,053,035 B2
(45) Date of Patent: May 30, 2006

(54) SOLVENT COMPOSITION

(75) Inventors: Tsuyoshi Hanada, Chiba (JP); Masaaki Tsuzaki, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 113 days.

(21) Appl. No.: 10/378,888

(22) Filed: Mar. 5, 2003

(65) Prior Publication Data

US 2003/0171240 A1 Sep. 11, 2003

(30) Foreign Application Priority Data

Mar. 6, 2002 (JP) ..... 2002-060591

(51) Int. Cl.
*C11D 7/50* (2006.01)

(52) U.S. Cl. ..... 510/407; 510/412; 510/177; 510/365

(58) Field of Classification Search ..... 252/364; 510/365, 417, 411, 412, 175, 407, 177
See application file for complete search history.

(56) References Cited

U.S. PATENT DOCUMENTS

| | | | | |
|---|---|---|---|---|
| 5,403,514 | A | 4/1995 | Matsuhisa et al. | |
| 5,454,969 | A | 10/1995 | Fields et al. | |
| 5,599,783 | A * | 2/1997 | Ide et al. | 510/412 |
| 5,667,594 | A * | 9/1997 | Omure et al. | 134/26 |
| 6,544,595 | B1 | 4/2003 | Hanada et al. | |
| 6,743,765 | B1 * | 6/2004 | Dournel et al. | 510/461 |

FOREIGN PATENT DOCUMENTS

| | | |
|---|---|---|
| CN | 1213697 A | 4/1999 |
| EP | 0 675 193 | 10/1995 |
| EP | 0 885 952 | 12/1998 |
| JP | 10-212498 | 8/1998 |
| JP | 10-251692 | 9/1998 |
| JP | 2000-192090 | 7/2000 |
| WO | WO 01/16422 | 3/2001 |

OTHER PUBLICATIONS

U.S. Appl. No. 10/292,596, filed Nov. 13, 2002, Hanada et al.
U.S. Appl. No. 10/378,888, filed Mar. 5, 2003, Hanada et al.

* cited by examiner

*Primary Examiner*—Gregory Webb
(74) *Attorney, Agent, or Firm*—Oblon, Spivak, McClelland, Maier & Neustadt, P.C.

(57) ABSTRACT

A solvent composition which comprises a fluorinated solvent containing no chlorine atom in its molecule, a hydrocarbon solvent and a glycol ether and which is free from phase separation, wherein the compositional ratio of the fluorinated solvent and the hydrocarbon solvent is a compositional ratio such that a two component mixture composed solely of the fluorinated solvent and the hydrocarbon in such a compositional ratio would separate into two phases.

18 Claims, No Drawings

SOLVENT COMPOSITION

The present invention relates to a solvent composition to be used for removing soils such as oils, fluxes or dusts adhered to articles, such as electronic components such as integrated circuits, precision (machinery) components, printed circuit boards or glass substrates.

Heretofore, in precision machinery industry, optical instrument industry, electrical and electronic industry, plastic processing industry, etc., a hydrochlorofluorocarbon (hereinafter referred to as HCFC) such as dichloropentafluoropropane (hereinafter referred to as R225) has been widely used for precision cleaning to remove oils, fluxes, dusts, waxes, etc. deposited on products, for example, during the production process. HCFC is a fluorinated solvent which is non-flammable and excellent in chemical and thermal stability and which has a good cleaning performance. However, HCFC contains chlorine atoms in its molecule and has an ozone-depletion potential. Accordingly, in developed countries, its production was totally banned in 2020. Under the circumstances, a fluorinated solvent containing no chlorine atom in its molecule, such as hydrofluorocarbon (hereinafter referred to as HFC) or hydrofluoroether (hereinafter referred to as HFE), has been developed. HFC or HFE is a fluorinated solvent which has no ozone-depletion potential and presents no substantial influence to the global environment, but it has had a problem that the cleaning performance is low. Accordingly, it has been proposed to use a mixture of such a fluorinated solvent with a glycol ether for the purpose of cleaning, for example, in JP-A-10-212498 or JP-A-10-251692.

When a cleaning agent is used for cleaning parts, etc., as the numerical value of the surface tension or the viscosity is low, the penetrability into e.g. a clearance of an article tends to be high, and the cleaning effect will be improved. In a solvent composition comprising a fluorinated solvent containing no chlorine atom in its molecule and a glycol ether, the glycol ether is usually homogeneously mixable with the fluorinated solvent, but its surface tension or viscosity is high as compared with a hydrocarbon solvent, and there has been a problem that as the amount of the glycol ether incorporated, increases, the penetrability of the cleaning agent decreases. Further, a glycol ether usually has a low volatility and thus has had a problem that the drying characteristics after the cleaning are poor.

On the other hand, a hydrocarbon solvent has a good cleaning performance like a glycol ether. Among hydrocarbon solvents, a hydrocarbon solvent having a low boiling point and a low flashing point, is uniformly mixable with a fluorinated solvent containing no chlorine atom in its molecule, like a glycol ether. However, if a solvent composition having a sufficient cleaning performance is prepared by using a low boiling point hydrocarbon solvent and such a fluorinated solvent, there has been a problem that such a composition tends to have a flashing point. Whereas, a hydrocarbon solvent having a high boiling point and a high flashing point is hardly uniformly mixable with a fluorinated solvent containing no chlorine atom in its molecule. Accordingly, a mixture of a high boiling point hydrocarbon solvent with such a fluorinated solvent has had a problem that it separates into two phases i.e. an upper phase of the hydrocarbon solvent and a lower phase of the fluorinated solvent, whereby the penetrability or drying characteristics tend to be inadequate, and it tends to be difficult to carry out the cleaning constantly.

The present invention provides a solvent composition which comprises a fluorinated solvent containing no chlorine atom in its molecule, a hydrocarbon solvent and a glycol ether and which is free from phase separation, wherein the compositional ratio of the fluorinated solvent and the hydrocarbon solvent is a compositional ratio such that a two component mixture composed solely of the fluorinated solvent and the hydrocarbon in such a compositional ratio would separate into two phases.

Further, the present invention provides a solvent composition which comprises a fluorinated solvent containing no chlorine atom in its molecule, a hydrocarbon solvent and a glycol ether, wherein the compositional ratio is such that the fluorinated solvent containing no chlorine atom in its molecule/the hydrocarbon solvent/the glycol ether=from 25 to 90 parts by mass/from 5 to 65 parts by mass/from 5 to 35 parts by mass.

Now, the present invention will be described in detail with reference to the preferred embodiments.

In the present invention, the fluorinated solvent containing no chlorine atom in its molecule may, for example, be HFC or HFE. HFC is a compound comprising fluorine atoms, hydrogen atoms and carbon atoms. HFE is a compound comprising fluorine atoms, hydrogen atoms, carbon atoms and an ether group (—O—). As HFC or HFE, a non-flammable compound is preferred. If it is non-flammable, a mixture containing such a compound can be made non-flammable, such being preferred.

HFC may specifically be linear HFC such as 1,1,1,2,2,3,4,5,5,5-decafluoropentane, 1,1,1,2,2,3,3,4,4,5,5,6,6-tridecafluorohexane, 1,1,1,3,3-pentafluorobutane, or 1,1,1,2,2,3,3,4,4-nonafluorohexane, or cyclic HFC such as 1,1,2,2,3,3,4-heptafluorocyclopentane. HFC in the present invention is preferably HFC having from 4 to 10 carbon atoms.

HFE may specifically be linear or branched HFE, such as linear or branched nonafluorobutyl methyl ether, nonafluorobutyl ethyl ether, 1,1,2,2-tetrafluoroethyl-2,2,2-trifluoroethyl ether, difluoromethyl-2,2,3,3-tetrafluoropropyl ether, or 1,1,2,2-tetrafluoroethyl-2,2,3,3-tetrafluoropropyl ether. HFE in the present invention is preferably HFE having from 4 to 10 carbon atoms.

Such HFC or such HFE may be used of one type only or in combination of two or more types.

In the present invention, the hydrocarbon solvent is not particularly limited, but is preferably one having from 6 to 18 carbon atoms, more preferably from 7 to 14 carbon atoms. Among them, particularly preferred is one having a standard boiling point of at least 100° C. The hydrocarbon solvent in the present invention is preferably one having a standard boiling point of at least 100° C., whereby the flashing point will be high, and the solvent composition of the present invention may be made to be a non-flammable composition even if the content of the hydrocarbon solvent is made large. A more preferred range of the standard boiling point is from 100 to 250° C.

Further, the hydrocarbon solvent in the present invention is preferably an aliphatic hydrocarbon, an alicyclic hydrocarbon or an aromatic hydrocarbon. As specific examples, n-octane, 2-methylheptane, 3-methylheptane, 4-methylheptane, 3-ethylhexane, 2,2-dimethylhexane, 2,3-dimethylhexane, 2,4-dimethylhexane, 2,5-dimethylhexane, 3,3-dimethylhexane, 3,4-dimethylhexane, 2-methyl-3-ethylpentane, 3-methyl-3-ethylpentane, 2,3,3-trimethylpentane, 2,3,4-trimethylpentane, 2,2,3-trimethylpentane, 2,2,4-trimethylbutane, 2,2,3,3-tetramethylbutane, n-nonane, 2,2,5-trimethylhexane, n-decane, n-dodecane, 1-octene, 1-nonene, 1-decene, methylcyclohexane, ethylcyclohexane, p-menthane, bicyclohexyl, α-pinene, dipentene, decalin, tetralin, toluene, xylene, ethylbenzene, methylethylbenzene, cumene, mesitylene, tetralin, butylbenzene, cymene, cyclohexylbenzene, diethylbenzene, pentylbenzene, dipentylbenzene, etc., may preferably be mentioned. In the present invention, the hydrocarbon solvents may be used alone individually, or in combination of two or more of them.

In the present invention, the glycol ether is preferably a compound having the hydrogen atom of one or each hydroxyl group in a dimer to tetramer of a bivalent alcohol having from 2 to 4 carbon atoms, substituted by a $C_{1-6}$ alkyl group.

The glycol ether in the present invention is preferably an alkyl ether of diethylene glycol, or an alkyl ether of dipropylene glycol. Specifically, it may, preferably, be a diethylene glycol ether, such as diethylene glycol monomethyl ether, diethylene glycol monoethyl ether, diethylene glycol mono-n-propyl ether, diethylene glycol monoisopropyl ether, diethylene glycol mono-n-butyl ether, diethylene glycol monoisobutyl ether, diethylene glycol dimethyl ether, diethylene glycol diethyl ether or diethylene glycol dibutyl ether, or a dipropylene glycol ether, such as dipropylene glycol monomethyl ether, dipropylene glycol monoethyl ether, dipropylene glycol mono-n-propyl ether, dipropylene glycol monoisopropyl ether, dipropylene glycol mono-n-butyl ether or dipropylene glycol monoisobutyl ether. The glycol ethers in the present invention may be used alone or in combination as a mixture of two or more of them.

In the present invention, the compositional ratio of the fluorinated solvent containing no chlorine atom in its molecule and the hydrocarbon solvent, may be any compositional ratio, so long as it is a ratio such that a mixture composed solely of the fluorinated solvent and the hydrocarbon solvent, would separate into two phases, but if a glycol ether is incorporated thereto, the mixture would be free from phase separation. Here, "separates into two phases" means that the mixture of the above two types of solvents will be separated into two phases, so that an interface will be present between the two phases.

The solvent composition of the present invention is preferably non-flammable. The solvent composition of the present invention can be made non-inflammable by adjusting the amount of the fluorinated solvent containing no chlorine atom in its molecule.

Further, the amount of the glycol ether may be any amount so long as it is an amount where the solvent composition of the present invention will not separate into two phases. However, the smaller the amount of the glycol ether, the better, since the penetrability or the drying characteristics will thereby increase. Specifically, the amount of the glycol ether is preferably from 5 to 35 mass %, particularly preferably from 5 to 25 mass %, in the solvent composition. In the solvent composition of the present invention, it is preferred that the content of the hydrocarbon solvent is larger by mass than the content of the glycol ether.

The compositional ratio of the solvent composition of the present invention is specifically preferably such that, when the total of the three components is 100 parts by mass, the fluorinated solvent containing no chlorine atom in its molecule/the hydrocarbon solvent/the glycol ether=from 25 to 90 parts by mass/from 5 to 65 parts by mass/from 5 to 35 parts by mass, particularly preferably from 45 to 90 parts by mass/from 5 to 55 parts by mass/from 5 to 25 parts by mass.

To the solvent composition of the present invention, at least one type of compound selected from the group consisting of alcohols, ketones, halogenated hydrocarbons, ethers and esters, may be added as a component to further increase the cleaning performance. The content of such a compound in the solvent composition is preferably at most 40% (based on mass, the same applies hereinafter), more preferably at most 20%, further preferably at most 10%.

The alcohols are preferably $C_{1-16}$ linear or cyclic alcohols, which include, for example, methyl alcohol, ethyl alcohol, 1-propanol, 2-propanol, 1-butanol, 2-butanol, 2-methyl-1-propanol, 2-methyl-2-propanol, 1-pentanol, 2-pentanol, 3-pentanol, 2-methyl-1-butanol, 3-methyl-1-butanol, 2-methyl-2-butanol, 3-methyl-2-butanol, 2,2-dimethyl-1-propanol, 1-hexanol, 2-methyl-1-pentanol, 4-methyl-2-pentanol, 2-ethyl-1-butanol, 1-heptanol, 2-heptanol, 3-heptanol, 1-octanol, 2-octanol, 2-ethyl-1-hexanol, 1-nonanol, 3,5,5-trimethyl-1-hexanol, 1-decanol, 1-undecanol, 1-dodecanol, allyl alcohol, propargyl alcohol, benzyl alcohol, cyclohexanol, 1-methylcyclohexanol, 2-methylcyclohexanol, 3-methylcyclohexanol, 4-methylcyclohexanol, α-terpineol, 2,6-dimethyl-4-heptanol, nonyl alcohol, and tetradecyl alcohol.

The ketones are preferably $C_{3-9}$ linear or cyclic ketones. Specifically, they include, for example, acetone, methyl ethyl ketone, 2-pentanone, 3-pentanone, 2-hexanone, methyl isobutyl ketone, 2-heptanone, 3-heptanone, 4-heptanone, diisobutyl ketone, acetonyl acetone, mesityl oxide, phorone, isophorone, 2-octanone, cyclohexanone, methylcyclohexanone, isophorone, 2,4-pentanedione, 2,5-hexanedionene, diacetone alcohol, and acetophenone.

The halogenated hydrocarbons are preferably $C_{1-6}$ chlorinated or chlorofluorinated hydrocarbons, which include, for example, dichloromethane, 1,1-dichloroethane, 1,2-dichloroethane, 1,1,2-trichloroethane, 1,1,1,2-tetrachloroethane, 1,1,2,2-tetrachloroethane, pentachloroethane, 1,1-dichloroethylene, cis-1,2-dichloroethylene, trans-1,2-dichloroethylene, trichloroethylene, tetrachloroethylene, 1,2-dichloropropane, dichloropentafluoropropane and dichlorofluoroethane.

The ethers are preferably $C_{2-8}$ linear or cyclic ethers, which include, for example, diethyl ether, dipropyl ether, diisopropyl ether, dibutyl ether, ethyl vinyl ether, butyl vinyl ether, anisole, phenetole, methyl anisole, dioxane, furan, methyl furan and tetrahydrofuran.

The esters are preferably $C_{2-18}$ linear or cyclic saturated or unsaturated esters. Specifically, they include, for example, methyl formate, ethyl formate, propyl formate, butyl formate, isobutyl formate, pentyl formate, methyl acetate, ethyl acetate, propyl acetate, isopropyl acetate, butyl acetate, isobutyl acetate, sec-butyl acetate, pentyl acetate, methoxybutyl acetate, sec-hexyl acetate, 2-ethylbutyl acetate, 2-ethylhexyl acetate, cyclohexyl acetate, benzyl acetate, methyl propionate, ethyl propionate, butyl propionate, methyl butyrate, ethyl butyrate, butyl butyrate, isobutyl isobutyrate, ethyl 2-hydroxy-2-methyl propionate, methyl benzoate, ethyl benzoate, propyl benzoate, butyl benzoate, benzyl benzoate, γ-butyrolactone, diethyl oxalate, dibutyl oxalate, dipentyl oxalate, diethyl malonate, dimethyl maleate, diethyl maleate, dibutyl maleate, dibutyl tartrate, tributyl citrate, dibutyl sebacate, dimethyl phthalate, diethyl phthalate and dibutyl phthalate.

Further, for the purpose of primarily improving the stability, one or more types of the following compounds may, for example, be incorporated to the solvent composition of the present invention within a range of from 0.001 to 5% based on the solvent composition.

A nitro compound such as nitromethane, nitroethane, nitropropane or nitrobenzene. An amine such as diethylamine, triethylamine, iso-propylamine or n-butylamine. A phenol such as phenol, o-cresol, m-cresol, p-cresol, thymol, p-t-butylphenol, t-butylcatechol, catechol, isoeugenol, o-methoxyphenol, bisphenol A, isoamyl salicylate, benzyl salicylate, methyl salicylate or 2,6-di-t-butyl-p-cresol. A triazole such as 2-(2'-hydroxy-5'-methylphenyl)benzotriazole, 2-(2'-hydroxy-3'-t-butyl-5'-methylphenyl)-5-chlorobenzotriazole, 1,2,3-benzotriazole, or 1-[(N,N-bis-2-ethylhexyl)aminomethyl]benzotriazole.

The solvent composition of the present invention is useful for various applications in the same manner as the conventional R225 analogue compositions. Specific applications include an application as a cleaning agent to remove soils adhered to an article and an application as a carrier solvent for coating various compounds on an article, or as an extracting agent. The material for the above article may, for example, be glass, ceramics, plastic, elastomer or metal. Specific examples of such an article include an electronic or electrical equipment, a precision machinery or equipment, an optical instrument, and a component thereof, such as an integrated circuit, a micromotor, a relay, a bearing, an optical lens, a printed board or a glass substrate.

The soils adhered to the article may, for example, be soils which are used for the manufacture of the article or components constituting the article and which must be finally removed, or soils which are adhered during the use of the article. The substance constituting the soils may, for example, be an oil such as a grease, a mineral oil, a wax or an oil-based ink, a flux, or a dust.

As a specific means to remove the soils, hand wiping, dipping, spraying, mechanical agitation, ultrasonic cleaning, etc., may, for example, be employed singly or in combination. In order to improve the drying or finishing after the cleaning, the cleaning with the solvent mixture may be followed by rinsing with a fluorinated solvent, and drying which may be carried out by applying a vapor of a fluorinated solvent.

Now, the present invention will be described in further detail with reference to Examples. However, it should be understood that the present invention is by no means restricted to such specific Examples.

As a fluorinated solvent containing no chlorine atom in its molecule, 1,1,1,2,2,3,3,4,4,5,5,6,6-tridecafluorohexane (hereinafter referred to as HFC52-13p), 1,1,1,2,2,3,4,5,5,5-decafluoropentane (hereinafter referred to as HFC43-10mee) or nonafluorobutyl methyl ether (hereinafter referred to as HFE449s) was used. As a hydrocarbon solvent, a paraffin type hydrocarbon solvent (NS Clean 100, trade name, manufactured by Nikko Petrochemicals Co., Ltd., boiling point: 171° C.) (hereinafter referred to as NS100), a paraffin type hydrocarbon solvent (HC-250, trade name, manufactured by TOSOH CORPORATION, boiling point: 172° C.) (hereinafter referred to as HC250) or an aromatic hydrocarbon solvent (Solfine™, trade name, manufactured by Showa Denko K.K., boiling point: 160 to 180° C.) (hereinafter referred to as Solfine) was used. As a glycol ether, diethylene glycol mono-n-butyl ether (hereinafter referred to as DEGMBE), diethylene glycol di-n-butyl ether (hereinafter referred to as DEGDBE) or dipropylene glycol monomethyl ether (hereinafter referred to as DPGMME) was used. The following tests were carried out.

Examples 1 to 3, 10 to 12, 16 to 19 and 21 are Working Examples of the present invention, and Examples 4 to 9, 13 to 15, 20 and 22 are Comparative Examples.

EXAMPLES 1 to 9

100 g of the composition as identified in Table 1, prepared. The mixed state after gently shaking it, was inspected. The results are shown in Table 1.

TABLE 1

| Ex. No. | Compositional ratio of solvents (mass ratio) | Mixed state |
|---|---|---|
| 1 | HFC52-13p/Solfine/DEGDBE = 60/20/20 | Uniformly mixed (no phase separation) |
| 2 | HFC43-10mee/HC250/DEGMBE = 50/35/15 | Uniformly mixed (no phase separation) |
| 3 | HFE449s/NS100/DPGMME = 40/50/10 | Uniformly mixed (no phase separation) |
| 4 | HFC52-13p/Solfine = 75/25 | Separated into two phases |
| 5 | HFC52-13p/Solfine = 60/40 | Separated into two phases |
| 6 | HFC43-10mee/HC250 = 59/41 | Separated into two phases |
| 7 | HFC43-10mee/HC250 = 50/50 | Separated into two phases |
| 8 | HFE449s/NS100 = 44/56 | Separated into two phases |
| 9 | HFE449s/NS100 = 40/60 | Separated into two phases |

EXAMPLES 10 to 15

A test piece of 25 mm×40 mm×2 mm made of SS-304 and having the weight previously measured, was immersed in Daphne Cut AS-40H i.e. a cutting oil made of Idemitsu Kosan Co., Ltd. and withdrawn, whereupon the weight (A) of the test piece was measured. Amount of oil adhered before cleaning=measured value of (A)−weight of the test piece. Then, the test piece was immersed in the composition as identified in Table 2 and subjected to ultrasonic wave cleaning at room temperature for 3 minutes. After the cleaning, the cleaned test piece was immersed in the same fluorinated solvent as contained in the composition used for the cleaning and rinsed for 3 minutes, and further contacted with a vapor of the fluorinated solvent for 3 minutes for drying. After the drying, the weight (B) of the test piece was measured. Amount of oil remaining after the cleaning=measured value of (B)−weight of the test piece. By the following formula, the oil remaining rate was measured. Oil remaining rate=100×amount of oil remaining after the cleaning/amount of oil adhered before the cleaning. An oil remaining rate of less than 1% was represented by ○, and an oil remaining rate of at least 1% was represented by X. The results are shown in Table 2.

TABLE 2

| Ex. No. | Compositional ratio of solvents | Oil remaining rate |
|---|---|---|
| 10 | HFC52-13p/Solfine/DEGDEE = 60/20/20 | ○ |
| 11 | HFC43-10mee/HC250/DEGMBE = 50/35/15 | ○ |
| 12 | HFE449s/NS100/DPGMME = 40/50/10 | ○ |
| 13 | NFC52-13p | X |
| 14 | HFC43-10mee | X |
| 15 | HBE449s | X |

EXAMPLES 16 to 18

The composition as identified in Table 3 was prepared, and presence or absence of a flashing point was confirmed in accordance with the method disclosed in ASTM D 92-90 by means of Cleveland open system flashing point measuring apparatus. The results are shown in Table 3.

TABLE 3

| Ex. No. | Compositional ratio of solvents | Presence or absence of flashing point |
|---|---|---|
| 16 | HFC52-13p/Solfine/DEGMBE = 60/20/20 | Nil |
| 17 | HFC43-10mee/HC250/DEGMBE = 50/35/15 | Nil |
| 18 | HFE449s/NS100/DPGDBE = 40/50/10 | Nil |

EXAMPLES 19 and 20

The composition as identified in Table 4 was prepared, and with respect to such a composition, the surface tension at 25° C. was measured by means of a CBVP system surface tension meter, manufactured by Kyowa Interface Science Co., LTD., and the viscosity at 25° C. was measured by means of a viscometer D-15KT manufactured by Lauda Company. The results are shown in Table 4.

TABLE 4

| Ex. No. | Compositional ratio of solvents | Surface tension [mN/m] | Viscosity [mPa · s] |
|---|---|---|---|
| 19 | HFE449s/NS100/DEGMBE = 40/55/5 | 19 | 0.9 |
| 20 | HFE449s/DEGMBE = 40/60 | 24 | 2.5 |

EXAMPLES 21 and 22

A test piece of 25 mm×40 mm×2 mm made of SS-304 and having the weight previously measured, was immersed in the composition as identified in Table 5, and the weight (C) of the test piece was measured. Amount of the solvent adhered before being left to stand=measured value of (C)−weight of the test piece. Then, the weight (D) of the test piece after being left in a room of 25° C. for 15 minutes, was measured. Amount of the solvent remaining after being left for 15 minutes=measured value of (D)−weight of the test piece. The remaining rate of the solvent on the test piece after being left for 15 minutes, was obtained by the following formula. Remaining rate of the solvent=remaining rate of the solvent after being left for 15 minutes/amount of the solvent adhered before being left.

TABLE 5

| Ex. No. | Compositional ratio of solvents | Remaining rate [%] of the solvent |
|---|---|---|
| 21 | HFC52-13p/NS100/DEGMBE = 40/40/20 | 50 |
| 22 | HFC52-13p/DEGMBE = 40/60 | 92 |

The solvent composition of the present invention is a solvent composition excellent in the cleaning property, the penetrability into a clearance in an article to be cleaned and the drying characteristics of the solvent. Further, by adjusting the compositional ratio of solvents, it is possible to obtain a non-flammable solvent composition which is excellent in the penetrability, the cleaning properties and the drying characteristics by adjusting the compositional ratio of solvents.

The entire disclosure of Japanese Patent Application No. 2002-061591 filed on Mar. 6, 2002 including specification, claims and summary is incorporated herein by reference in its entirety.

What is claimed is:

1. A method of reducing bleed-through in a scanned image, the scanned image including a group of pixels, the method comprisIng:

generating an upper bound for each pixel of the group, each upper bound based on intensity values of a local pixel neighborhood; and taking a weighted average of the upper bound and original pixel intensity for each pixel of the group.

2. The method of claim 1, further comprising generating a lower bound for each pixel of the group; wherein the lower bound is included in the weighted average.

3. The method of claim 2, wherein the upper and lower bounds for each pixel are based on local pixel neighborhoods.

4. The method of claim 2, wherein taking the weighted average includes taking a first weighted average of the upper and lower bounds to yield a smoothed pixel intensity, and taking a second weighted average of the smoothed pixel intensity arid the original pixel intensity, the second weighted average yielding an output pixel.

5. The method of claim 4, wherein certain features in the scanned image ure preserved by not pushing Intensity of the output pixel toward the smoothed intensity.

6. The method of claim 4. wherein the first weighted average is generated as $G=\alpha U+(1-\alpha)L$ for $(O\leqq\alpha\leqq 1)$, Where G is the smoothed pixel intensity, U and L are the upper and lower bounds, and $\alpha$is a local lightening weight that is a function of local intensity.

7. The method of claim 6, wherein the local lightening weight is biased toward $\alpha=1$.

8. The method of claim 4, wherein the second weighted average is taken as $R=\beta G+(1-\beta)I$ for$(O\leqq\beta\leqq 1)$ where G is the smoothed pixel intensity, I is the original pixel intensity, $\beta$is a smoothing weight, and R is an output pixel.

9. The method of claim 1, wherein the weighted average smoothes pixel intensity dips in light regions.

10. The method of claim 2, wherein the weighted average darkens and smoothes dark foreground pixel Intensities in dark regions.

11. The method of claim 1, further comprising reducing noise in the digital image prior to generating the upper bound.

12. The method or claim 1, wherein the digital image is a color image, and wherein only a luminance channel of the color image is processed by generating the smoothed pixel intensity and selectively using the original pixel intensity.

13. A method of processing a pixel of a digital image, the method comprising:

generating a smoothed pixel intensity with respect to a local pixel neighborhood; and selectively using original pixel intensity to modify the smoothed pixel intensity to help preserve a certain feature of the digital image.

14. The method of claim 13, wherein the pixel intensity is smoothed by generating a weighted average of upper and lower bounds of the pixel: wherein weighting is a function of a local intensity value.

15. The method of claim 13, wherein the smoothed intensity is selectively used by taking a weighted average of the smoothed pixel intensity and the original pixel intensity; wherein weighting is a function of local contrast.

16. A digital imaging system comprising:

a capture device for generating a digital image; and a processor for performing bleed-through reduction on a plurality of pixels of the digital image, for each pixel the processor generating an upper the upper bound and original pixel intensity for each pixel of the group, the upper bound for each pixel based on intensity values of a local pixel neighborhood.

17. Apparatus for performing bleed-through reduction on a plurality of pixels of a digital image, the apparatus comprising a processor for processing the pixels, for each pixel the processing including generating an upper bound for each pixel of the group, and taking a weighted average of the upper bound and original pixel intensity for each pixel of tile group, each upper bound based on intensity values of a local pixel neighborhood.

18. An article for causing a processor to perform bleed-through reduction on a pixel of a digital Image, the article comprising memory encoded with code for instructing the processor to process the pixel by generating an upper bound of pixel intensity for each pixel of the group, and taking a weighted average of the upper bound and original pixel intensity for each pixel of the group, each upper bound computed from a local pixel neighborhood.

* * * * *

UNITED STATES PATENT AND TRADEMARK OFFICE

CERTIFICATE OF CORRECTION

PATENT NO. : 7,053,035 B2
APPLICATION NO. : 10/378888
DATED : May 30, 2006
INVENTOR(S) : Hanada et al.

It is certified that error appears in the above-identified patent and that said Letters Patent is hereby corrected as shown below:

Please Delete Column 1 Line 1 Through Column 10 Line 11 And Insert Column 1 Line 1 Through Column 10 Line 14 As Attached Signed and Sealed this Eleventh Day of November, 2008

JON W. DUDAS
*Director of the United States Patent and Trademark Office*

SOLVENT COMPOSITION

The present invention relates to a solvent composition to be used for removing soils such as oils, fluxes or dusts adhered to articles, such as electronic components such as integrated circuits, precision (machinery) components, printed circuit boards or glass substrates.

Heretofore, in precision machinery industry, optical instrument industry, electrical and electronic industry, plastic processing industry, etc., a hydrochlorofluorocarbon (hereinafter referred to as HCFC) such as dichloropentafluoropropane (hereinafter referred to as R225) has been widely used for precision cleaning to remove oils, fluxes, dusts, waxes, etc. deposited on products, for example, during the production process. HCFC is a fluorinated solvent which is non-flammable and excellent in chemical and thermal stability and which has a good cleaning performance. However, HCFC contains chlorine atoms in its molecule and has an ozone-depletion potential. Accordingly, in developed countries, its production was totally banned in 2020. Under the circumstances, a fluorinated solvent containing no chlorine atom in its molecule, such as hydrofluorocarbon (hereinafter referred to as HFC) or hydrofluoroether (hereinafter referred to as HFE), has been developed. HFC or HFE is a fluorinated solvent which has no ozone-depletion potential and presents no substantial influence to the global environment, but it has had a problem that the cleaning performance is low. Accordingly, it has been proposed to use a mixture of such a fluorinated solvent with a glycol ether for the purpose of cleaning, for example, in JP-A-10-212498 or JP-A-10-251692.

When a cleaning agent is used for cleaning parts, etc., as the numerical value of the surface tension or the viscosity is low, the penetrability into e.g. a clearance of an article tends to be high, and the cleaning effect will be improved. In a solvent composition comprising a fluorinated solvent containing no chlorine atom in its molecule and a glycol ether, the glycol ether is usually homogeneously mixable with the fluorinated solvent, but its surface tension or viscosity is high as compared with a hydrocarbon solvent, and there has been a problem that as the amount of the glycol ether incorporated, increases, the penetrability of the cleaning agent decreases. Further, a glycol ether usually has a low volatility and thus has had a problem that the drying characteristics after the cleaning are poor.

On the other hand, a hydrocarbon solvent has a good cleaning performance like a glycol ether. Among hydrocarbon solvents, a hydrocarbon solvent having a low boiling point and a low flashing point, is uniformly mixable with a fluorinated solvent containing no chlorine atom in its molecule, like a glycol ether. However, if a solvent composition having a sufficient cleaning performance is prepared by using a low boiling point hydrocarbon solvent and such a fluorinated solvent, there has been a problem that such a composition tends to have a flashing point. Whereas, a hydrocarbon solvent having a high boiling point and a high flashing point is hardly uniformly mixable with a fluorinated solvent containing no chlorine atom in its molecule. Accordingly, a mixture of a high boiling point hydrocarbon solvent with such a fluorinated solvent has had a problem that it separates into two phases i.e. an upper phase of the hydrocarbon solvent and a lower phase of the fluorinated solvent, whereby the penetrability or drying characteristics tend to be inadequate, and it tends to be difficult to carry out the cleaning constantly.

The present invention provides a solvent composition which comprises a fluorinated solvent containing no chlorine atom in its molecule, a hydrocarbon solvent and a glycol ether and which is free from phase separation, wherein the compositional ratio of the fluorinated solvent and the hydrocarbon solvent is a compositional ratio such that a two component mixture composed solely of the fluorinated solvent and the hydrocarbon in such a compositional ratio would separate into two phases.

Further, the present invention provides a solvent composition which comprises a fluorinated solvent containing no chlorine atom in its molecule, a hydrocarbon solvent and a glycol ether, wherein the compositional ratio is such that the fluorinated solvent containing no chlorine atom in its molecule/the hydrocarbon solvent/the glycol ether=from 25 to 90 parts by mass/from 5 to 65 parts by mass/from 5 to 35 parts by mass.

Now, the present invention will be described in detail with reference to the preferred embodiments.

In the present invention, the fluorinated solvent containing no chlorine atom in its molecule may, for example, be HFC or HFE. HFC is a compound comprising fluorine atoms, hydrogen atoms and carbon atoms. HFE is a compound comprising fluorine atoms, hydrogen atoms, carbon atoms and an ether group (—O—). As HFC or HFE, a non-flammable compound is preferred. If it is non-flammable, a mixture containing such a compound can be made non-flammable, such being preferred.

HFC may specifically be linear HFC such as 1,1,1,2,2,3,4,5,5,5-decafluoropentane, 1,1,1,2,2,3,3,4,4,5,5,6,6-tridecafluorohexane, 1,1,1,3,3-pentafluorobutane, or 1,1,1,2,2,3,3,4,4-nonafluorohexane, or cyclic HFC such as 1,1,2,2,3,3,4-heptafluorocyclopentane. HFC in the present invention is preferably HFC having from 4 to 10 carbon atoms.

HFE may specifically be linear or branched HFE, such as linear or branched nonafluorobutyl methyl ether, nonafluorobutyl ethyl ether, 1,1,2,2-tetrafluoroethyl-2,2,2-trifluoroethyl ether, difluoromethyl-2,2,3,3-tetrafluoropropyl ether, or 1,1,2,2-tetrafluoroethyl-2,2,3,3-tetrafluoropropyl ether. HFE in the present invention is preferably HFE having from 4 to 10 carbon atoms.

Such HFC or such HFE may be used of one type only or in combination of two or more types.

In the present invention, the hydrocarbon solvent is not particularly limited, but is preferably one having from 6 to 18 carbon atoms, more preferably from 7 to 14 carbon atoms. Among them, particularly preferred is one having a standard boiling point of at least 100° C. The hydrocarbon solvent in the present invention is preferably one having a standard boiling point of at least 100° C., whereby the flashing point will be high, and the solvent composition of the present invention may be made to be a non-flammable composition even if the content of the hydrocarbon solvent is made large. A more preferred range of the standard boiling point is from 100 to 250° C.

Further, the hydrocarbon solvent in the present invention is preferably an aliphatic hydrocarbon, an alicyclic hydrocarbon or an aromatic hydrocarbon. As specific examples, n-octane, 2-methylheptane, 3-methylheptane, 4-methylheptane, 3-ethylhexane, 2,2-dimethylhexane, 2,3-dimethylhexane, 2,4-dimethylhexane, 2,5-dimethylhexane, 3,3-dimethylhexane, 3,4-dimethylhexane, 2-methyl-3-ethylpentane, 3-methyl-3-ethylpentane, 2,3,3-trimethylpentane, 2,3,4-trimethylpentane, 2,2,3-trimethylpentane, 2,2,4-trimethylbutane, 2,2,3,3-tetramethylbutane, n-nonane, 2,2,5-trimethylhexane, n-decane, n-dodecane, 1-octene, 1-nonene, 1-decene, methylcyclohexane, ethylcyclohexane, p-menthane, bicyclohexyl, α-pinene, dipentene, decalin, tetralin, toluene, xylene, ethylbenzene, methylethylbenzene, cumene, mesitylene, tetralin, butylbenzene, cymene, cyclohexylbenzene, diethylbenzene, pentylbenzene, dipentylbenzene, etc., may preferably be mentioned. In the present invention, the hydrocarbon solvents may be used alone individually, or in combination of two or more of them.

In the present invention, the glycol ether is preferably a compound having the hydrogen atom of one or each hydroxyl group in a dimer to tetramer of a bivalent alcohol having from 2 to 4 carbon atoms, substituted by a $C_{1-6}$ alkyl group.

The glycol ether in the present invention is preferably an alkyl ether of diethylene glycol, or an alkyl ether of dipropylene glycol. Specifically, it may, preferably, be a diethylene glycol ether, such as diethylene glycol monomethyl ether, diethylene glycol monoethyl ether, diethylene glycol mono-n-propyl ether, diethylene glycol monoisopropyl ether, diethylene glycol mono-n-butyl ether, diethylene glycol monoisobutyl ether, diethylene glycol dimethyl ether, diethylene glycol diethyl ether or diethylene glycol dibutyl ether, or a dipropylene glycol ether, such as dipropylene glycol monomethyl ether, dipropylene glycol monoethyl ether, dipropylene glycol mono-n-propyl ether, dipropylene glycol monoisopropyl ether, dipropylene glycol mono-n-butyl ether or dipropylene glycol monoisobutyl ether. The glycol ethers in the present invention may be used alone or in combination as a mixture of two or more of them.

In the present invention, the compositional ratio of the fluorinated solvent containing no chlorine atom in its molecule and the hydrocarbon solvent, may be any compositional ratio, so long as it is a ratio such that a mixture composed solely of the fluorinated solvent and the hydrocarbon solvent, would separate into two phases, but if a glycol ether is incorporated thereto, the mixture would be free from phase separation. Here, "separates into two phases" means that the mixture of the above two types of solvents will be separated into two phases, so that an interface will be present between the two phases.

The solvent composition of the present invention is preferably non-flammable. The solvent composition of the present invention can be made non-inflammable by adjusting the amount of the fluorinated solvent containing no chlorine atom in its molecule.

Further, the amount of the glycol ether may be any amount so long as it is an amount where the solvent composition of the present invention will not separate into two phases. However, the smaller the amount of the glycol ether, the better, since the penetrability or the drying characteristics will thereby increase. Specifically, the amount of the glycol ether is preferably from 5 to 35 mass %, particularly preferably from 5 to 25 mass %, in the solvent composition. In the solvent composition of the present invention, it is preferred that the content of the hydrocarbon solvent is larger by mass than the content of the glycol ether.

The compositional ratio of the solvent composition of the present invention is specifically preferably such that, when the total of the three components is 100 parts by mass, the fluorinated solvent containing no chlorine atom in its molecule/the hydrocarbon solvent/the glycol ether=from 25 to 90 parts by mass/from 5 to 65 parts by mass/from 5 to 35 parts by mass, particularly preferably from 45 to 90 parts by mass/from 5 to 55 parts by mass/from 5 to 25 parts by mass.

To the solvent composition of the present invention, at least one type of compound selected from the group consisting of alcohols, ketones, halogenated hydrocarbons, ethers and esters, may be added as a component to further increase the cleaning performance. The content of such a compound in the solvent composition is preferably at most 40% (based on mass, the same applies hereinafter), more preferably at most 20%, further preferably at most 10%.

The alcohols are preferably $C_{1-16}$ linear or cyclic alcohols, which include, for example, methyl alcohol, ethyl alcohol, 1-propanol, 2-propanol, 1-butanol, 2-butanol, 2-methyl-1-propanol, 2-methyl-2-propanol, 1-pentanol, 2-pentanol, 3-pentanol, 2-methyl-1-butanol, 3-methyl-1-butanol, 2-methyl-2-butanol, 3-methyl-2-butanol, 2,2-dimethyl-1-propanol, 1-hexanol, 2-methyl-1-pentanol, 4-methyl-2-pentanol, 2-ethyl-1-butanol, 1-heptanol, 2-heptanol, 3-heptanol, 1-octanol, 2-octanol, 2-ethyl-1-hexanol, 1-nonanol, 3,5,5-trimethyl-1-hexanol, 1-decanol, 1-undecanol, 1-dodecanol, allyl alcohol, propargyl alcohol, benzyl alcohol, cyclohexanol, 1-methylcyclohexanol, 2-methylcyclohexanol, 3-methylcyclohexanol, 4-methylcyclohexanol, α-terpineol, 2,6-dimethyl-4-heptanol, nonyl alcohol, and tetradecyl alcohol.

The ketones are preferably $C_{3-9}$ linear or cyclic ketones. Specifically, they include, for example, acetone, methyl ethyl ketone, 2-pentanone, 3-pentanone, 2-hexanone, methyl isobutyl ketone, 2-heptanone, 3-heptanone, 4-heptanone, diisobutyl ketone, acetonyl acetone, mesityl oxide, phorone, isophorone, 2-octanone, cyclohexanone, methylcyclohexanone, isophorone, 2,4-pentanedione, 2,5-hexanedionene, diacetone alcohol, and acetophenone.

The halogenated hydrocarbons are preferably $C_{1-6}$ chlorinated or chlorofluorinated hydrocarbons, which include, for example, dichloromethane, 1,1-dichloroethane, 1,2-dichloroethane, 1,1,2-trichloroethane, 1,1,1,2-tetrachloroethane, 1,1,2,2-tetrachloroethane, pentachloroethane, 1,1-dichloroethylene, cis-1,2-dichloroethylene, trans-1,2-dichloroethylene, trichloroethylene, tetrachloroethylene, 1,2-dichloropropane, dichloropentafluoropropane and dichlorofluoroethane.

The ethers are preferably $C_{2-8}$ linear or cyclic ethers, which include, for example, diethyl ether, dipropyl ether, diisopropyl ether, dibutyl ether, ethyl vinyl ether, butyl vinyl ether, anisole, phenetole, methyl anisole, dioxane, furan, methyl furan and tetrahydrofuran.

The esters are preferably $C_{2-18}$ linear or cyclic saturated or unsaturated esters. Specifically, they include, for example, methyl formate, ethyl formate, propyl formate, butyl formate, isobutyl formate, pentyl formate, methyl acetate, ethyl acetate, propyl acetate, isopropyl acetate, butyl acetate, isobutyl acetate, sec-butyl acetate, pentyl acetate, methoxybutyl acetate, sec-hexyl acetate, 2-ethylbutyl acetate, 2-ethylhexyl acetate, cyclohexyl acetate, benzyl acetate, methyl propionate, ethyl propionate, butyl propionate, methyl butyrate, ethyl butyrate, butyl butyrate, isobutyl isobutyrate, ethyl 2-hydroxy-2-methyl propionate, methyl benzoate, ethyl benzoate, propyl benzoate, butyl benzoate, benzyl benzoate, γ-butyrolactone, diethyl oxalate, dibutyl oxalate, dipentyl oxalate, diethyl malonate, dimethyl maleate, diethyl maleate, dibutyl maleate, dibutyl tartrate, tributyl citrate, dibutyl sebacate, dimethyl phthalate, diethyl phthalate and dibutyl phthalate.

Further, for the purpose of primarily improving the stability, one or more types of the following compounds may, for example, be incorporated to the solvent composition of the present invention within a range of from 0.001 to 5% based on the solvent composition.

A nitro compound such as nitromethane, nitroethane, nitropropane or nitrobenzene. An amine such as diethylamine, triethylamine, iso-propylamine or n-butylamine. A phenol such as phenol, o-cresol, m-cresol, p-cresol, thymol, p-t-butylphenol, t-butylcatechol, catechol, isoeugenol, o-methoxyphenol, bisphenol A, isoamyl salicylate, benzyl salicylate, methyl salicylate or 2,6-di-t-butyl-p-cresol. A triazole such as 2-(2'-hydroxy-5'-methylphenyl)benzotriazole, 2-(2'-hydroxy-3'-t-butyl-5'-methylphenyl)-5-chlorobenzotriazole, 1,2,3-benzotriazole, or 1-[(N,N-bis-2-ethylhexyl) aminomethyl]benzotriazole.

The solvent composition of the present invention is useful for various applications in the same manner as the conventional R225 analogue compositions. Specific applications include an application as a cleaning agent to remove soils adhered to an article and an application as a carrier solvent for coating various compounds on an article, or as an extracting agent. The material for the above article may, for example, be glass, ceramics, plastic, elastomer or metal. Specific examples of such an article include an electronic or electrical equipment, a precision machinery or equipment, an optical instrument, and a component thereof, such as an integrated circuit, a micromotor, a relay, a bearing, an optical lens, a printed board or a glass substrate.

The soils adhered to the article may, for example, be soils which are used for the manufacture of the article or components constituting the article and which must be finally removed, or soils which are adhered during the use of the article. The substance constituting the soils may, for example, be an oil such as a grease, a mineral oil, a wax or an oil-based ink, a flux, or a dust.

As a specific means to remove the soils, hand wiping, dipping, spraying, mechanical agitation, ultrasonic cleaning, etc., may, for example, be employed singly or in combination. In order to improve the drying or finishing after the cleaning, the cleaning with the solvent mixture may be followed by rinsing with a fluorinated solvent, and drying which may be carried out by applying a vapor of a fluorinated solvent.

Now, the present invention will be described in further detail with reference to Examples. However, it should be understood that the present invention is by no means restricted to such specific Examples.

As a fluorinated solvent containing no chlorine atom in its molecule, 1,1,1,2,2,3,3,4,4,5,5,6,6-tridecafluorohexane (hereinafter referred to as HFC52-13p), 1,1,1,2,2,3,4,5,5,5-decafluoropentane (hereinafter referred to as HFC43-10mee) or nonafluorobutyl methyl ether (hereinafter referred to as HFE449s) was used. As a hydrocarbon solvent, a paraffin type hydrocarbon solvent (NS Clean 100, trade name, manufactured by Nikko Petrochemicals Co., Ltd., boiling point: 171° C.) (hereinafter referred to as NS100), a paraffin type hydrocarbon solvent (HC-250, trade name, manufactured by TOSOH CORPORATION, boiling point: 172° C.) (hereinafter referred to as HC250) or an aromatic hydrocarbon solvent (Solfine™, trade name, manufactured by Showa Denko K.K., boiling point: 160 to 180° C.) (hereinafter referred to as Solfine) was used. As a glycol ether, diethylene glycol mono-n-butyl ether (hereinafter referred to as DEGMBE), diethylene glycol di-n-butyl ether (hereinafter referred to as DEGDBE) or dipropylene glycol monomethyl ether (hereinafter referred to as DPGMME) was used. The following tests were carried out.

Examples 1 to 3, 10 to 12, 16 to 19 and 21 are Working Examples of the present invention, and Examples 4 to 9, 13 to 15, 20 and 22 are Comparative Examples.

EXAMPLES 1 to 9

100 g of the composition as identified in Table 1, prepared. The mixed state after gently shaking it, was inspected. The results are shown in Table 1.

TABLE 1

| Ex. No. | Compositional ratio of solvents (mass ratio) | Mixed state |
|---|---|---|
| 1 | HFC52-13p/Solfine/DEGDBE = 60/20/20 | Uniformly mixed (no phase separation) |
| 2 | HFC43-10mee/HC250/DEGMBE = 50/35/15 | Uniformly mixed (no phase separation) |
| 3 | HFE449s/NS100/DPGMME = 40/50/10 | Uniformly mixed (no phase separation) |
| 4 | HFC52-13p/Solfine = 75/25 | Separated into two phases |
| 5 | HFC52-13p/Solfine = 60/40 | Separated into two phases |
| 6 | HFC43-10mee/HC250 = 59/41 | Separated into two phases |
| 7 | HFC43-10mee/HC250 = 50/50 | Separated into two phases |
| 8 | HFE449s/NS100 = 44/56 | Separated into two phases |
| 9 | HFE449s/NS100 = 40/60 | Separated into two phases |

EXAMPLES 10 to 15

A test piece of 25 mm×40 mm×2 mm made of SS-304 and having the weight previously measured, was immersed in Daphne Cut AS-40H i.e. a cutting oil made of Idemitsu Kosan Co., Ltd. and withdrawn, whereupon the weight (A) of the test piece was measured. Amount of oil adhered before cleaning=measured value of (A)−weight of the test piece. Then, the test piece was immersed in the composition as identified in Table 2 and subjected to ultrasonic wave cleaning at room temperature for 3 minutes. After the cleaning, the cleaned test piece was immersed in the same fluorinated solvent as contained in the composition used for the cleaning and rinsed for 3 minutes, and further contacted with a vapor of the fluorinated solvent for 3 minutes for drying. After the drying, the weight (B) of the test piece was measured. Amount of oil remaining after the cleaning=measured value of (B)−weight of the test piece. By the following formula, the oil remaining rate was measured. Oil remaining rate=100× amount of oil remaining after the cleaning/amount of oil adhered before the cleaning. An oil remaining rate of less than 1% was represented by ○, and an oil remaining rate of at least 1% was represented by X. The results are shown in Table 2.

TABLE 2

| Ex. No. | Compositional ratio of solvents | Oil remaining rate |
|---|---|---|
| 10 | HFC52-13p/Solfine/DEGDEE = 60/20/20 | ○ |
| 11 | HFC43-10mee/HC250/DEGMBE = 50/35/15 | ○ |
| 12 | HFE449s/NS100/DPGMME = 40/50/10 | ○ |
| 13 | NFC52-13p | X |
| 14 | HFC43-10mee | X |
| 15 | HBE449s | X |

EXAMPLES 16 to 18

The composition as identified in Table 3 was prepared, and presence or absence of a flashing point was confirmed in accordance with the method disclosed in ASTM D 92-90 by means of Cleveland open system flashing point measuring apparatus. The results are shown in Table 3.

TABLE 3

| Ex. No. | Compositional ratio of solvents | Presence or absence of flashing point |
|---|---|---|
| 16 | HFC52-13p/Solfine/DEGMBE = 60/20/20 | Nil |
| 17 | HFC43-10mee/HC250/DEGMBE = 50/35/15 | Nil |
| 18 | HFE449s/NS100/DPGDBE = 40/50/10 | Nil |

EXAMPLES 19 and 20

The composition as identified in Table 4 was prepared, and with respect to such a composition, the surface tension at 25° C. was measured by means of a CBVP system surface tension meter, manufactured by Kyowa Interface Science Co., LTD., and the viscosity at 25° C. was measured by means of a viscometer D-15KT manufactured by Lauda Company. The results are shown in Table 4.

TABLE 4

| Ex. No. | Compositional ratio of solvents | Surface tension [mN/m] | Viscosity [mPa · s] |
|---|---|---|---|
| 19 | HFE449s/NS100/DEGMBE = 40/55/5 | 19 | 0.9 |
| 20 | HFE449s/DEGMBE = 40/60 | 24 | 2.5 |

EXAMPLES 21 and 22

A test piece of 25 mm×40 mm×2 mm made of SS-304 and having the weight previously measured, was immersed in the composition as identified in Table 5, and the weight (C) of the test piece was measured. Amount of the solvent adhered before being left to stand=measured value of (C)−weight of the test piece. Then, the weight (D) of the test piece after being left in a room of 25° C. for 15 minutes, was measured. Amount of the solvent remaining after being left for 15 minutes=measured value of (D)−weight of the test piece. The remaining rate of the solvent on the test piece after being left for 15 minutes, was obtained by the following formula. Remaining rate of the solvent=remaining rate of the solvent after being left for 15 minutes/amount of the solvent adhered before being left.

TABLE 5

| Ex. No. | Compositional ratio of solvents | Remaining rate [%] of the solvent |
|---|---|---|
| 21 | HFC52-13p/NS100/DEGMBE = 40/40/20 | 50 |
| 22 | HFC52-13p/DEGMBE = 40/60 | 92 |

The solvent composition of the present invention is a solvent composition excellent in the cleaning property, the penetrability into a clearance in an article to be cleaned and the drying characteristics of the solvent. Further, by adjusting the compositional ratio of solvents, it is possible to obtain a non-flammable solvent composition which is excellent in the penetrability, the cleaning properties and the drying characteristics by adjusting the compositional ratio of solvents.

The entire disclosure of Japanese Patent Application No. 2002-061591 filed on Mar. 6, 2002 including specification, claims and summary is incorporated herein by reference in its entirety.

What is claimed is:

1. A solvent composition which comprises a fluorinated solvent containing no chlorine atom in its molecule, a hydrocarbon solvent and a glycol ether and which is free from phase separation, wherein the compositional ratio of the fluorinated solvent and the hydrocarbon solvent is a compositional ratio such that a two component mixture composed solely of the fluorinated solvent and the hydrocarbon in such a compositional ratio would separate into two phases.

2. The solvent composition according to claim 1, wherein the content of the hydrocarbon solvent is larger by mass than the content of the glycol ether in the solvent composition.

3. The solvent composition according to claim 1, wherein the content of the glycol ether in the solvent composition is from 5 to 35 mass%.

4. The solvent composition according to claim 1, wherein the compositional ratio in the solvent composition is such that the fluorinated solvent containing no chlorine atom in its molecule/the hydrocarbon solvent/the glycol ether = from 25 to 90 parts by mass/from 5 to 65 parts by mass/from 5 to 35 parts by mass.

5. The solvent composition according to claim 1, wherein the solvent composition is non-flammable.

6. A solvent composition which comprises a fluorinated solvent containing no chlorine atom in its molecule, a hydrocarbon solvent and a glycol ether, wherein the compositional ratio is such that the fluorinated solvent containing no chlorine atom in its molecule/the hydrocarbon solvent/the glycol ether = from 25 to 90 parts by mass/from 5 to 65 parts by mass/from 5 to 35 parts by mass.

7. The solvent composition according to claim 6, wherein the content of the hydrocarbon solvent is larger by mass than the content of the glycol ether in the solvent composition.

8. The solvent composition according to claim 6, wherein the solvent composition is non-flammable.

9. The solvent composition according to claim 1, wherein the fluorinated solvent containing no chlorine atom in its molecule is at least one of an HFC, or at least one of an HFE, or mixtures thereof.

10. The solvent composition according to claim 1, wherein the glycol ether is a compound having the hydrogen atom of one or each hydroxyl group in a dimer to tetramer of a bivalent alcohol having from 2 to 4 carbon atoms, substituted by a $C_{1-6}$ alkyl group.

11. The solvent composition according to claim 4, wherein the compositional ratio in the solvent composition is such that the fluorinated solvent containing no chlorine atom in its molecule/the hydrocarbon solvent/the glycol ether = from 45 to 90 parts by mass/from 5 to 55 parts by mass/from 5 to 25 parts by mass.

12. The solvent composition according to claim 1, wherein the fluorinated solvent containing no chlorine atom in its molecule is selected from the group consisting of 1,1,1,2,2,3,3,4,4,5,5,6,6-tridecafluorohexane, 1,1,1,2,2,3,4,5,5,5-decafluoropentane, and nonafluorobutyl methyl ether; the hydrocarbon solvent has a standard boiling point of from 100 to 250° C.; and the glycol ether is selected from the group consisting of diethylene glycol mono-n-butyl ether, diethylene glycol di-n-butyl ether, and dipropylene glycol monomethyl ether.

13. The solvent composition according to claim 6, wherein the fluorinated solvent containing no chlorine atom in its molecule is at least one of an HFC, or at least one of an HFE, or mixtures thereof.

14. The solvent composition according to claim 6, wherein the glycol ether is a compound having the hydrogen atom of one or each hydroxyl group in a dimer to tetramer of a bivalent alcohol having from 2 to 4 carbon atoms, substituted by a $C_{1-6}$ alkyl group.

15. The solvent composition according to claim 6, wherein the compositional ratio in the solvent composition is such that the fluorinated solvent containing no chlorine atom in its molecule/the hydrocarbon solvent/the glycol ether = from 45 to 90 parts by mass/from 5 to 55 parts by mass/from 5 to 25 parts by mass.

16. The solvent composition according to claim 6, wherein the fluorinated solvent containing no chlorine atom in its molecule is selected from the group consisting of 1,1,1,2,2,3,3,4,4,5,5,6,6-tridecafluorohexane,1,1,1,2,2,3,4,5,5,5-decafluoropentane, and nonafluorobutyl methyl ether; the hydrocarbon solvent has a standard boiling point of from 100 to 250° C.; and the glycol ether is selected from the group consisting of diethylene glycol mono-n-butyl ether, diethylene glycol di-n-butyl ether, and dipropylene glycol monomethyl ether.

17. A method comprising removing soils adhered to an article by applying the solvent composition according to claim 1 thereto.

18. A method comprising removing soils adhered to an article by applying the solvent composition according to claim 6 thereto.

* * * * *